United States Patent [19]

Steiner et al.

[11] 4,341,949

[45] Jul. 27, 1982

[54] ELECTRICAL HEATING APPARATUS WITH A HEATING ELEMENT OF PTC MATERIAL

[75] Inventors: Herbert Steiner, Traunstein; Johann Magg, St. Georgen, both of Fed. Rep. of Germany

[73] Assignee: Bosch-Siemens Hausgeräte GmbH, Stuttgart, Fed. Rep. of Germany

[21] Appl. No.: 175,637

[22] Filed: Aug. 6, 1980

[30] Foreign Application Priority Data

Aug. 7, 1979 [DE] Fed. Rep. of Germany ..... 2932026

[51] Int. Cl.[3] ..... H05B 3/12; H05B 3/36

[52] U.S. Cl. ..... 219/553; 219/439; 219/441; 219/505; 219/540; 219/548; 338/22 R

[58] Field of Search ..... 219/302, 328, 430, 438, 219/439, 441, 464, 530, 540, 548, 541, 552, 553, 505; 338/22 R, 22 SD

[56] References Cited

U.S. PATENT DOCUMENTS

| | | | |
|---|---|---|---|
| 3,733,462 | 5/1973 | Bouchard et al. | 219/464 |
| 3,835,434 | 9/1974 | Kahn | 338/22 R |
| 3,891,827 | 6/1975 | Wyse | 219/302 |
| 3,976,854 | 8/1976 | Ishikawa et al. | 219/505 |
| 4,177,375 | 12/1979 | Meixner | 219/441 |
| 4,223,208 | 9/1980 | Kleinschmidt et al. | 219/530 |
| 4,230,935 | 10/1980 | Meixner | 219/523 |

*Primary Examiner*—Volodymyr Y. Mayewsky
*Attorney, Agent, or Firm*—Herbert L. Lerner; Laurence. A. Greenberg

[57] ABSTRACT

Electrical heating apparatus, including a frame formed of insulating material having an opening formed therethrough, a heating element formed of positive temperature coefficient material having two opposing outer surfaces and being disposed in the opening formed in the frame, an electrically-conducting current supply contact layer disposed on each of the two opposing outer surfaces of the heating element, an electrically conducting current input electrode plate formed of yieldable material being anchored in the frame and being disposed on each of the contact layers forming an integral structural unit enclosing the heating element, and a heat conducting plate formed of insulating material disposed on each of the electrode plates receiving heat transfered through the contact layers and clamping the heating element under pressure.

13 Claims, 7 Drawing Figures

ELECTRICAL HEATING APPARATUS WITH A HEATING ELEMENT OF PTC MATERIAL

The invention relates to an electrical heating apparatus with a heating element of cold-conducting material or PTC material having electrically conducting layers for the current supply on two opposing surfaces through which the generated heat is transfered to two heat-conducting plates made of insulating material, between which the heating element is clamped under pressure, and the heating element is covered on the two free sides which have the contact layers with insulating material plates with the inter-position of a layer of a yielding material on each side.

This type of electric heating apparatus has already been proposed in the German Published, Non-Prosecuted Patent Application No. 27 43 880 and in Petty Pat. No. 78 04 316. The heating devices described in these publications must be constructed with great care to avoid undesired contact of the cold-conducting element with the heater body into which it is installed, i.e. electric short-circuits. The feed-through of the electric current through the heated heater body is especially difficult.

It is accordingly an object of the invention to provide an electric heating device with a heating element of cold-conducting material which overcomes the hereinafore-mentioned disadvantages of the heretofore-known devices of this general type, and the manufacturing cost of which is reduced, especially because less assembly effort is required in the construction.

With the foregoing and other objects in view there is provided, in accordance with the invention, an electrical heating apparatus, comprising a frame formed of insulating material having an opening formed therethrough, a heating element formed of cold-conducting material having two opposing outer surfaces and being disposed in the opening formed in the frame, an electrically-conducting current supply contact layer disposed on each of the two opposing outer surfaces of the heating element, an electrically conducting current input electrode plate formed fo yieldable material being anchored in the frame and being disposed on each of the contact layers forming an integral structural unit enclosing the heating element, and a heat conducting plate formed of insulating material disposed on each of the electrode plates receiving heat transfered through the contact layers and clamping the heating element under pressure.

This construction has the advantage that the two cold-conductor elements which together form one heater, in the form of two or three adjacently positioned elements for example, are held securely between the electrodes and the insulating material frame, and can be installed as a completed structural unit at the assembly. Furthermore, this construction has the advantage that the insulating material frame and the electrode plates protect the cold-conductive elements which are very easily broken during transport and during the installation in the heating device.

In accordance with another feature of the invention, there are provided means for permanently fastening the electrode plates to the frame.

In accordance with a further feature of the invention, the fastening means is a rivet.

In accordance with an additional feature of the invention, there are provided electrical connection lines for supplying current to the electrode plates, the lines being held to the electrode plates by the fastening means. The permanently (riveted) connected leads also facilitate the assembly operation, because the heating element unit can be held at the connecting leads, and inserted in the provided place.

In accordance with an added feature of the invention, the fastening means are in the form of connector elements integral with the electrode plates. In this way the separate rivets can be omitted, and also a more secure electrical connection is obtained, because a contact by touching between the rivet and the electrode plate is also omitted thereby.

In accordance with yet another feature of the invention, the electrical connection lines and the electrode plates are disposed at different sides of the frame, the fastening means forming an electrical connection between the lines and electrode plates. In this manner the limited space available is well utilized, and the insulating material frame is thereby securely fastened in a centered or middle position relative to the thickness of the cold conducting elements.

In accordance with yet a further feature of the invention, there are provided contact lugs integral with the electrode plates, the fastening means being disposed on the lugs, and the lugs being offset so as to align the frame at half the height of the cold conducting heating element. In this way a rivet head which extends above the offset part does not prevent the contact of a flat insulating material disc on the electrode. Furthermore, the correct position of the insulating material frame is assured by this construction.

In accordance with yet an additional feature of the invention, the frame has other openings formed therethrough, and the fastening means are disposed at given sides of the electrode plates, and including lug-shaped projections being integral with the electrode plates at sides thereof opposite the given sides and extended over the cold-conducting heating elements, the projections being offset and hooked into the other openings in the form of hinges forming a secure anchored connection. This is done in order to achieve in this simple manner a further connection with the insulating material frame at a point away from the rivet joint, thereby making the structural unit even more solid.

In accordance with yet an added feature of the invention, at least the contact layers of the heating element extend beyond two opposite sides of the frame.

In accordance with still another feature of the invention, the heating element extends beyond the two opposite sides of the frame.

In accordance with still a further feature of the invention, the electrode plates completely cover and extend sideward beyond the contact layers.

In accordance with a concomitant feature of the invention, the frame is in the form of a thin mica-material disc.

Other features which are considered as characteristic for the invention are set forth in the appended claims.

Although the invention is illustrated and described herein as embodied in an electrical heating apparatus with a heating element of cold-conducting material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
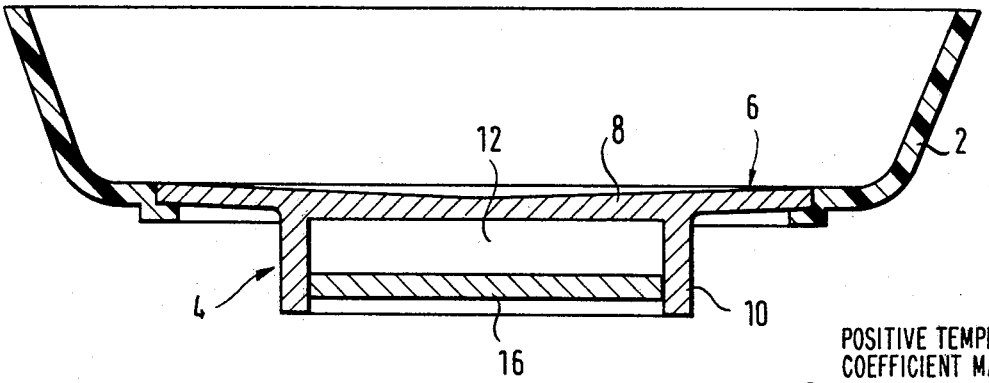
FIG. 1 is a diagrammatic cross-sectional view of a water dish of an electric egg-boiler having a bottom formed by a heating apparatus according to the invention, wherein the space for housing the heat-element assembly is shown, but the heat-element itself is omitted to simplify the drawing.
Figure 2:
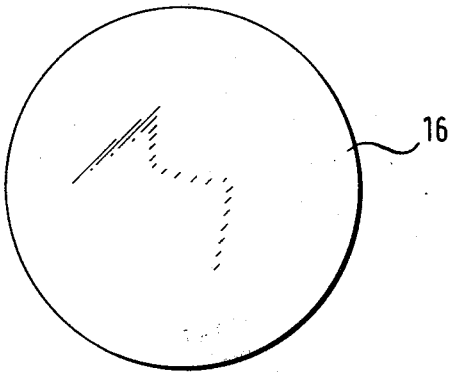
FIG. 2 is a bottom plan view of the cover of the space housing the heating element assembly shown in FIG. 1.

Referring now to the figures of the drawing and first particularly to FIGS. 1 and 2 thereof, it is seen that the water dish 2 of an electric egg-boiler is provided at the bottom thereof with an electric heating apparatus 4. This heating apparatus 4 includes a heating element 6 with a bottom plate 8 from which an annular wall 10 extends downward forming a housing space 12 for the heating element assembly 14 that is shown in other figures. The housing space 12 is closed at the bottom thereof by a cover 16 which is pressed onto the non-illustrated heating element assembly, and press-fitted into the annular ring 10. In this way the cover 16 transfers the heat discharged downward by the heating element 6 to the extension or annular wall 10.

Figure 4:
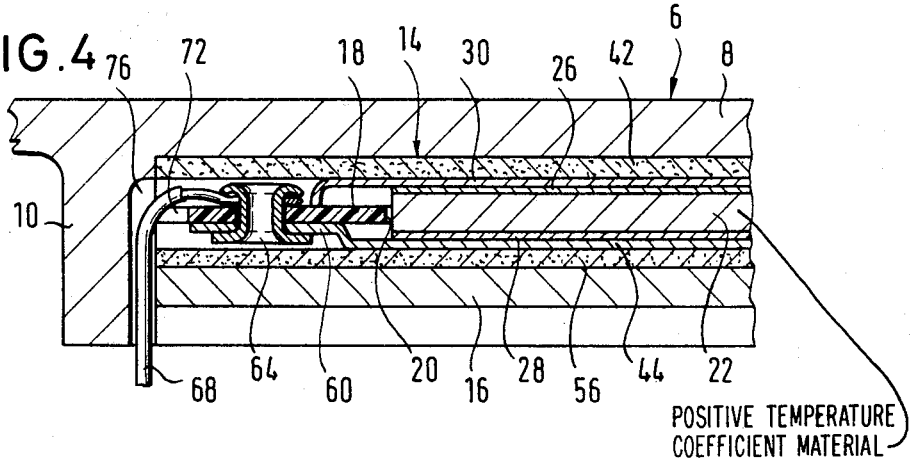
FIG. 4 is an enlarged fragmentary cross-sectional view taken essentially along the line IV—IV in FIG. 3, in the direction of the arrows.
Figure 3:
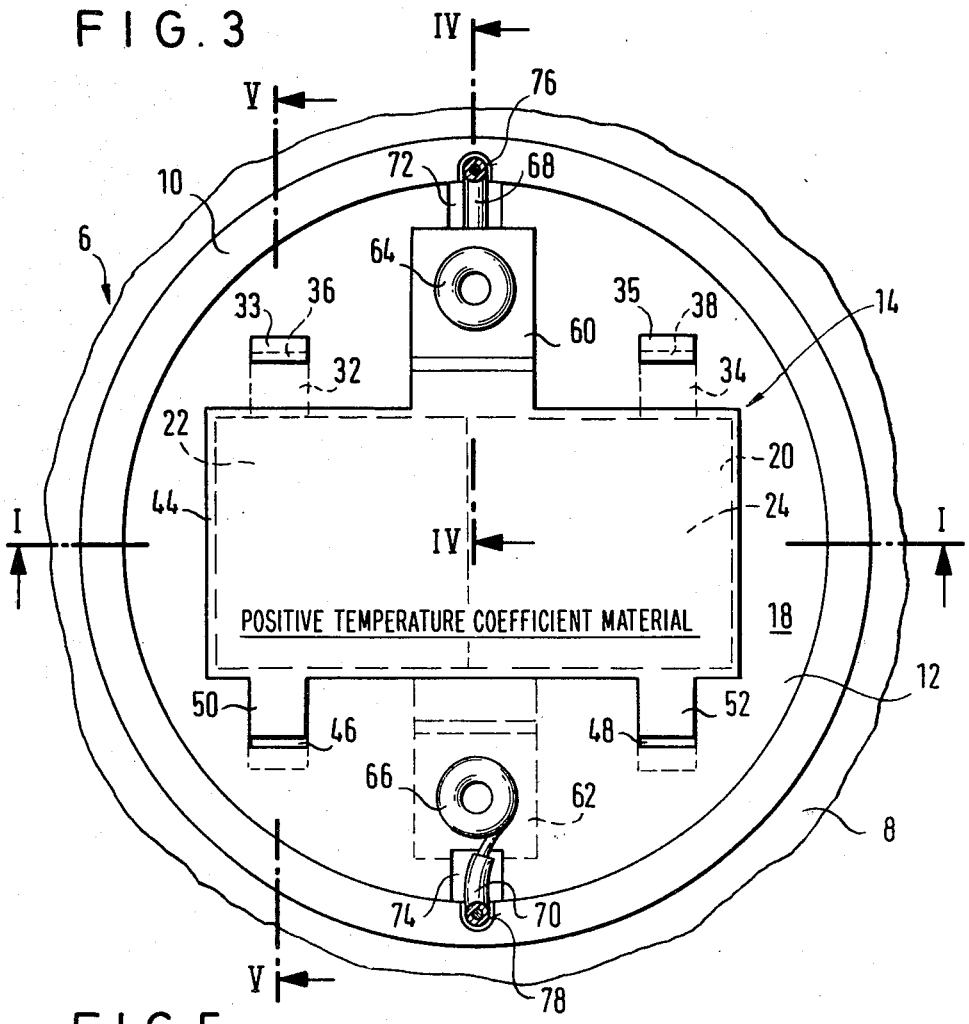
FIG. 3 is a fragmentary enlarged bottom plan view of the water dish according to FIG. 1, wherein the cover of the housing space and the lower insulating plate are removed, to show the insulating-material frame and the lower electrode plate.
Figure 5:
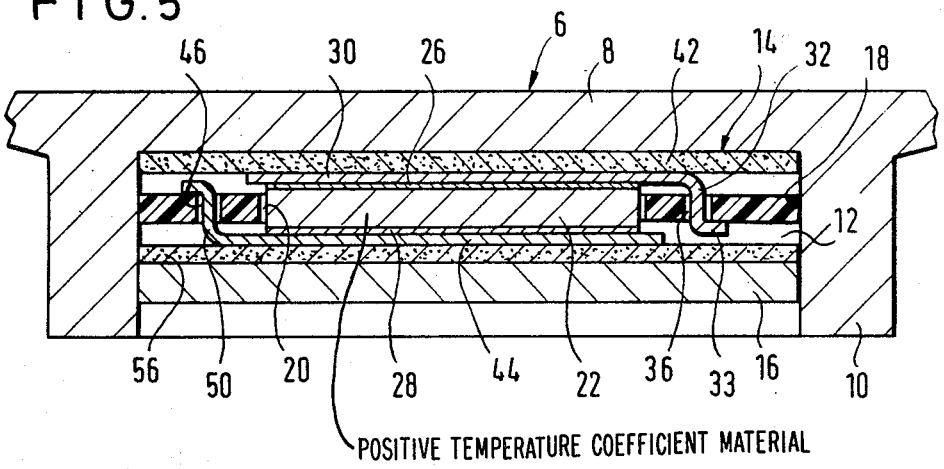
FIG. 5 is a view similar to FIG. 4, taken along line V—V in FIG. 3, is enlarged scale.

The construction of the heating element assembly in the housing space 12 can be seen from FIGS. 3 to 5. A frame 18 of insulating material in the form of a thin, round disc of mica, lies loosely in the housing space 12. The space 12 has a circular cross-section, and contains two adjacent heating elements 22 and 24 made of cold-conducting material loosely disposed in a large central opening 20. Each of the elements 22, 24 are provided on their top and bottom with contact layers 26 and 28 in the form of electrically conducting layers, formed of aluminum for example. An aluminum electrode plate 30, which is somewhat larger than the opening 20 of the insulating-material frame 18 for the contact elements, lies on the top of the contact layer 26 of the heating elements. The electrode plate 30 is provided with two mounting lugs or projections 32 and 34 which fit through openings 36 and 38 formed in the insulating frame 18, and offset portions 33 and 35 which hook in securely like hinges, for securing the electrode plate against position changes and rotation. Furthermore, the electrode plate 30 is provided with a contact lug 62.

A circular plate 42 made of an electrically insulating material is disposed between the electrode plate 30 and the bottom plate 8 which forms the top of the housing-space 12. An electrode plate 44 is placed on the bottom of the contact layers 28 of the heating elements 22 and 24. The electrode plate 44 is formed of soft aluminum as is the electrode plate 30 disposed on top. The plate 44 is provided with offset holding or mounting projections 50 and 52 which extend through the openings 46 and 48 of the insulating frame 18 as shown in FIGS. 3 and 5. The plate 44 also has a contact lug 60 which has an offset and extends sideward. A plate 56 made of electrically insulating material, corresponding in shape to the plan view of the cover shown in FIG. 2, is placed between the bottom electrode plate 44 and the cover 16, which is pressed in to close the housing space. Both insulating material plates are preferably formed of a heat conducting ceramic material, as for example aluminum-oxide or silicon resin. However, thin mica discs can also be used advantageously. As can be seen especially well in FIGS. 3 and 4, the electrode plates are provided at the sides thereof facing away from the mounting lugs with wide contact-lugs 60 and 62, formed in the plates. These lugs 60, 62 are offset in the space between the insulating-material plates 42 and 56, in order to lie flatly on the insulating frame 18 which is disposed at the middle vertical height of the cold-conducting elements 26, 28, as shown in FIG. 4, and to hold the insulating frame 18 at the right height. Consequently the heating elements 22, 24 and the contact layers 26, 28 thereof extend beyond both sides of the frame 18. The contact lugs 60, 62 and the insulating-material frame 18 each have a perforation, through which a tubular rivet 64, 66, respectively, is installed for making a rivet-connection between these parts, and also for clamping connecting line 68, 70, respectively, secured at the side of the insulating frame 18 at a distance from the contact lugs. The insulating material frame 18 has cutouts 72 and 74 at its rim in the continuation of the contact-lugs 60 and 62, through which the connection lines to the electric network can be brought-in to facilitate assembly. The connection-lines to the network 68 and 70 are led to the outside through vertical channels 76 and 78 in the inner surface of the annular wall 10, past the cover 16 and downward, as shown in FIGS. 3 and 4.

The electrode plates 30 and 44 are hooked into the insulating-material frame 18 at one side of the cold-conducting elements 22 and 24 at the pre-assembly operation of the heating element, and then placed over the cold-conducting elements, and they are attached on their other side, together with the connecting line secured to the insulating material frame by a rivet. In this manner, a sub-assembly is built in a relatively simple way, in which the cold-conducting elements are securely held, and which has extending connecting wire leads, through which the subassembly can be held during final assembly, and can be installed in the housing space 12 of the heating element 6. The insulating material frame 18 and the insulating material plates 42 and 56 advantageoulsy are formed of stamped plates of mica material, whereby the insulating material frame can, for example, be 0.7 mm thick, while the other insulating material plates are 0.07 mm thick.

Figure 6:
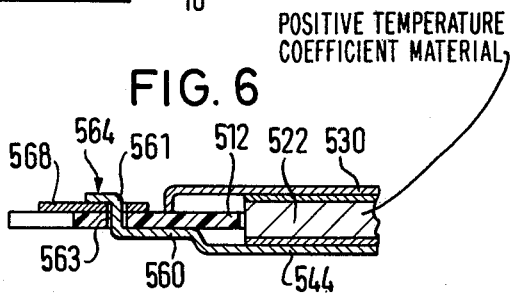
FIG. 6 is a fragmentary cross-sectional view of a further embodiment corresponding to FIG. 4.

The further embodiment shown in FIG. 6, including the cold-conducting elements 522 in an insulating material frame 512 and with electrode-plates 530 and 544 differs from the embodiment form shown in FIGS. 1 to 5 essentially by the introduction of the connection element 564 by way of which the rivet connection of the electrode plates is effected. The lower electrode plate 544 is provided with a contact lug 560 which extends with an end portion 561 forming the joint, through an opening 563 formed in the frame 512, and also through a corresponding opening formed in a contact lug 568 that is placed on the insulating material frame 512. The lug 560 is bent over the contact lug 560 so that the electrode 544 and the contact lug 568 are fastened at the insulating material frame 512. An electric connection line can be attached by means of a plug-in connecting element to the contact lug 568 which preferably is made of copper or brass.

Figure 7:
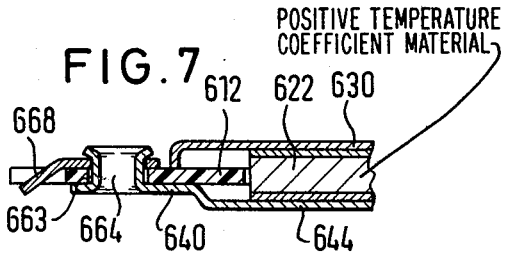
FIG. 7 is a view similar to FIG. 6, of another embodiment corresponding to FIG. 4.

Another embodiment shown in FIG. 7 has an insulating material frame 612 in which the cold-conducting elements 622 are contained, and to which an upper electrode plate 630 and a lower electrode plate 644 are secured. A contact lug 640 of the lower electrode plate 644 has formed therein a passage 664, which extends through an opening 663 formed in the insulating material frame 612, and also through a corresponding opening formed in a contact lug 668, and the lug 640 is turned over above the contact lug 668, in order to form a rivet connection. The upper electrode plate 630 is joined with the insulating frame and also with a contact lug by means of a non-illustrated but similar rivet connection. At the side facing away from the rivet connection, the electrode plates are each connected with the insulating material frame by means of hook-like hinge-connections according to the embodiment of FIGS. 1 to 5.

In an additional variation which may be used in all of the illustrated embodiments, the contact-lugs for the connection of the plug-in connector elements of the electric connection lines can also be formed directly at the electrode plates, which must be made of a suitable material in such a case. The rivet joints in that case serve only to connect the electrode plates with the insulating material frame.

There are claimed:

1. Electrical heating apparatus, comprising a frame formed of insulating material having an opening formed therethrough, a heating element formed of positive temperature coefficient material having two opposing outer surfaces and being disposed in said opening formed in said frame, an electrically-conducting current supply contact layer disposed on each of said two opposing outer surfaces of said heating element, an electrically conducting current input electrode plate formed of yieldable material and being disposed in electrical contact on the outer surface of each of said contact layers, said electrode plates being anchored in said frame forming an integral structural unit enclosing said heating element, and a heat conducting plate formed of electrically insulating material disposed on each of said electrode plates receiving heat transferred through said contact layers.

2. Electrical heating apparatus according to claim 1, including means for permanently fastening said electrode plates to said frame.

3. Electrical heating apparatus according to claim 2, wherein said fastening means is a rivet.

4. Electrical heating apparatus according to claim 2, including electrical connection lines for supplying current to said electrode plates, said lines being held to said electrode plates by said fastening means.

5. Electrical heating apparatus according to claim 2 or 4, wherein said fastening means are in the form of connector elements integral with said electrode plates.

6. Electrical heating apparatus according to claim 4 or 5, wherein said electrical connection lines and said electrode plates are disposed at different sides of said frame, said fastening means forming an electrical connection between said lines and electrode plates.

7. Electrical heating apparatus according to claim 2, including contact lugs integral with said electrode plates, said fastening means being disposed on said lugs, and said lugs being offset so as to align said frame at half the height of said heating element.

8. Electrical heating apparatus according to claim 2, wherein said frame has other openings formed therethrough, and said fastening means are disposed at given sides of said electrode plates, and including lug-shaped projections being integral with said electrode plates at sides thereof opposite said given sides and extended over said heating element, said projections being offset and hooked into said other openings in the form of hinges forming a secure anchored connection.

9. Electrical heating apparatus according to claim 1, wherein at least said contact layers of said heating element extend beyond two opposite sides of said frame.

10. Electrical heating apparatus according to claim 9, wherein said heating element extends beyond said two opposite sides of said frame.

11. Electrical heating apparatus according to claim 1, wherein said electrode plates completely cover and extend sideward beyond said contact layers.

12. Electrical heating apparatus according to claim 1, wherein said frame is in the form of a thin mica-material disc.

13. Electrical heating apparatus according to claim 1, wherein said frame clamps said heat conducting plate to said heating element under pressure when disposed in said opening.

* * * * *